US010370185B2

(12) United States Patent
Hindbo

(10) Patent No.: US 10,370,185 B2
(45) Date of Patent: Aug. 6, 2019

(54) BLADDER FOR CONTAINMENT VESSEL

(71) Applicant: THINK TANK PRODUCTS INC., Olds (CA)

(72) Inventor: Monte W. Hindbo, Olds (CA)

(73) Assignee: THINK TANK PRODUCTS INC., Olds (CA)

( * ) Notice: Subject to any disclaimer, the term of this patent is extended or adjusted under 35 U.S.C. 154(b) by 167 days.

(21) Appl. No.: 15/444,001

(22) Filed: Feb. 27, 2017

(65) Prior Publication Data

US 2017/0253427 A1 Sep. 7, 2017

Related U.S. Application Data

(60) Provisional application No. 62/302,256, filed on Mar. 2, 2016.

(51) Int. Cl.
*B65D 88/62* (2006.01)
*B65D 90/04* (2006.01)

(52) U.S. Cl.
CPC ..... *B65D 88/62* (2013.01); *B65D 90/046* (2013.01)

(58) Field of Classification Search
CPC ... B65D 88/62; B65D 90/046; B65D 2588/00
USPC ..... 260/601
See application file for complete search history.

(56) References Cited

U.S. PATENT DOCUMENTS

| | | | | | |
|---|---|---|---|---|---|
| 2,646,905 | A * | 7/1953 | Vincent | B65D 88/66 | 222/200 |
| 2,792,262 | A * | 5/1957 | Hathorn | B65D 88/62 | 193/2 R |
| 3,537,608 | A * | 11/1970 | Conder | B65D 88/34 | 220/530 |
| 3,941,258 | A * | 3/1976 | Ide | B65D 88/62 | 414/304 |
| 4,541,765 | A * | 9/1985 | Moore | B65D 88/62 | 220/1.6 |
| RE32,232 | E * | 8/1986 | Bonerb | B65D 88/62 | 222/105 |
| 4,826,045 | A * | 5/1989 | Price | B65D 88/62 | 222/95 |
| 2005/0063623 | A1* | 3/2005 | Eisenbarth | B65D 88/1612 | 383/119 |
| 2008/0310766 | A1* | 12/2008 | Plunkett | B65D 77/06 | 383/22 |

(Continued)

*Primary Examiner* — Derek J Battisti
(74) *Attorney, Agent, or Firm* — Crowe & Dunlevy, P.C.

(57) ABSTRACT

A containment vessel bladder for retaining material to be stored within a containment vessel. The bladder comprises a flexible enclosure and a drain facilitating element. The enclosure has a sealed interior, a floor portion connected to an enclosed top by one or more wall portions, and an opening for the delivery of material to the sealed interior. The drain facilitating element is positioned on the floor portion the enclosure and is expandable from a deflated position to an expanded position. When deflated the drain facilitating element is foldable with the enclosure to facilitate storage and transport of the containment vessel bladder. When expanded the drain facilitating element has one or more sloped surfaces aiding in the direction of material stored within the sealed interior toward a pre-determined location within the sealed interior to help facilitate the removal of material from the containment vessel bladder.

17 Claims, 6 Drawing Sheets

(56) References Cited

U.S. PATENT DOCUMENTS

2009/0242566 A1* 10/2009 Witheridge ..... B65D 88/34
220/495.01

* cited by examiner

BLADDER FOR CONTAINMENT VESSEL

CROSS REFERENCE TO RELATED APPLICATIONS

This application claims priority to and the benefit of U.S. Provisional Patent Application Ser. No. 62/302,256, filed Mar. 2, 2016, which is incorporated herein by reference in its entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A SEQUENCE LISTING, A TABLE, OR A COMPUTER PROGRAM LISTING APPENDIX

Not Applicable.

STATEMENT REGARDING PRIOR DISCLOSURES BY THE INVENTOR OR A JOINT INVENTOR

Not Applicable.

BACKGROUND OF THE INVENTION

1. Field of the Invention

This invention relates generally to the field of vessels that may be used to contain fluids, bulk solids and other materials, and in particular to a bladder used in connection with such vessels.

2. Description of the Related Art

Containment vessels, or tanks as they are sometimes referred to, are used in a wide variety of different industries and industrial, commercial and residential applications to contain fluids (including liquids and/or gases), granular solid material, etc. One particular form of containment vessel or tank that may be used generally comprises a rigid enclosure (often generally round in horizontal section) having an internal bladder that holds the material in question. The rigid enclosure provides structural support, whereas the bladder contains the material for storage in a manner that preserves its purity and integrity, and that limits exposure to the environment. Such vessels or tanks have proven to be advantageous on account of their relatively lightweight and their ease of assembly and disassembly for movement from location to location. Once assembled, the product to be stored is pumped or otherwise conveyed into the bladder. As material is deposited into the bladder the bladder fills the available space provided by the walls of the enclosure. When required, the material within the bladder can be pumped, drained or otherwise conveyed out of the bladder. The types of materials that can be stored in such tanks is extremely broad and can include, amongst other things, water, various gaseous products, liquid or solid food products, grains, industrial metals and minerals, oil, petro-chemicals, etc.

While such bladder tanks or containment vessels have proven to be highly desirable, in some instances it can be difficult to evacuate the entire contents of the bladder, particularly the final amount of material on the bladder floor at the bottom of the vessel, next to its outer walls. In addition, to help reduce capital cost, and to help minimize assembly and disassembly efforts, the top of such bladder containment vessels or tanks is commonly without a rigid lid or cover such that the upper portion of the bladder is exposed to the environment. In some instances, and in particular where the bladder may not be completely filled with material, the exposed upper surface of the bladder may have "low spots" which can lead to puddling or pooling of rainwater or snow and a reduced ability for rain and snow to drain or be directed from the top of the vessel.

Other advantages and features will be apparent from the following description and from the claims.

SUMMARY OF THE INVENTION

In an aspect the invention provides a containment vessel bladder for retaining material to be stored within a containment vessel, the bladder comprising a flexible enclosure having a sealed interior defined generally by a floor portion connected to an enclosed top by one or more wall portions, said enclosure further including an opening for the delivery of material into and the evacuation of material from said sealed interior, and a drain facilitating element positioned on said floor portion within said sealed interior of said flexible enclosure, said drain facilitating element expandable from a deflated or contracted position to an expanded position, when in said deflated position said drain facilitating element foldable with said enclosure to facilitate storage and transport of said containment vessel bladder, when in said expanded position said drain facilitating element having one or more sloped surfaces aiding in the direction of material stored within said sealed interior toward a pre-determined location within said sealed interior to help facilitate the removal of material from said containment vessel bladder.

In another aspect the invention provides a containment vessel bladder for retaining material to be stored within a containment vessel, the bladder comprising a flexible enclosure having a sealed interior defined generally by a floor portion connected to an enclosed top by one or more wall portions, said enclosure further including an opening for the delivery of material into and the evacuation of material from said sealed interior, and a ceiling shape retaining element positioned adjacent to said enclosed top and within the interior of said containment vessel bladder.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DETAILED DESCRIPTION OF THE INVENTION

Figure 2:
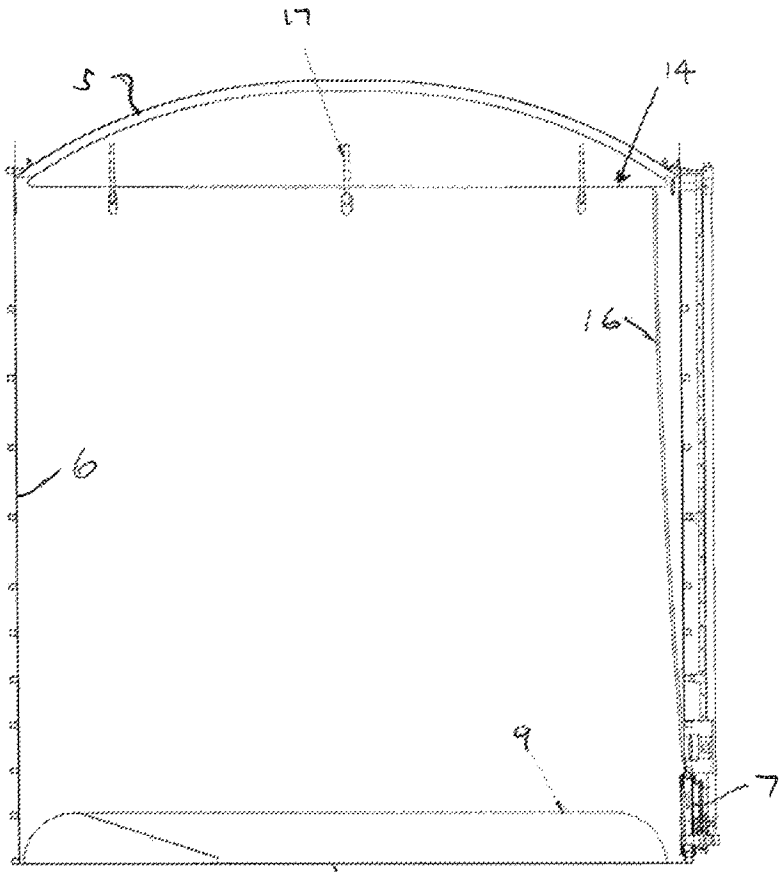
FIG. 2 is a vertical sectional view taken along the line 2-2 of FIG. 1.

The embodiments discussed herein are merely illustrative of specific manners in which to make and use this invention and are not to be interpreted as limiting in scope.

While the invention has been described with a certain degree of particularity, it is to be noted that many variations and modifications may be made in the details of the sequence, components, concentrations and/or the arrangement of the processes and compositions without departing from the scope of this disclosure. It is understood that the invention is not limited to the embodiments set forth herein for purposes of exemplification.

The description of the invention is intended to be read in connection with the accompanying drawings, which are to be considered part of the entire written description of this invention. In the description, relative terms such as "front," "rear," "lower," "upper," "horizontal," "vertical," "above," "below," "up," "down," "top" and "bottom" as well as derivatives thereof (e.g., "horizontally," "downwardly," "upwardly" etc.) should be construed to refer to the orientation as then described or as shown in the drawings under discussion. These relative terms are for convenience of description and do not require that the machine be constructed or the method to be operated in a particular orientation. Terms, such as "connected," "connecting," "attached," "attaching," "join" and "joining" are used interchangeably and refer to one structure or surface being secured to another structure or surface or integrally fabricated in one piece.

Figure 1:
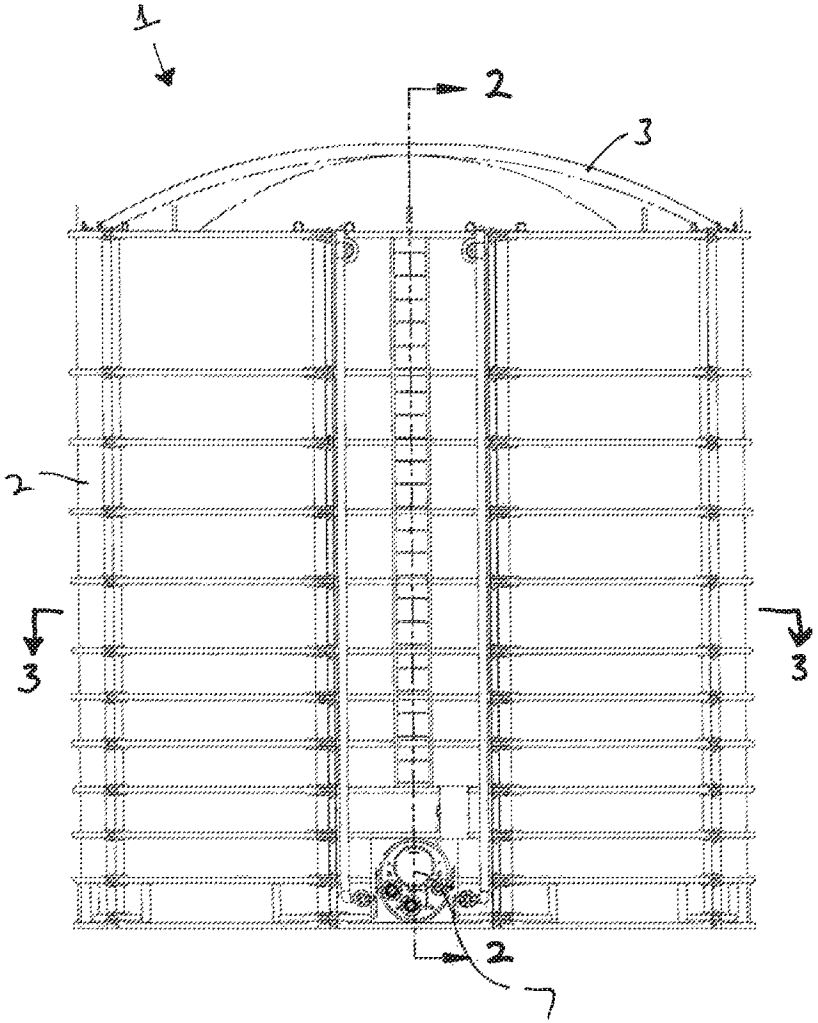
FIG. 1 is a side elevational view of a typical bladder tank or bladder containment vessel.

With reference to FIGS. 1 and 2 there is shown a typical bladder containment vessel 1 that is comprised generally of a rigid exterior shell 2 and an internal containment vessel bladder 3. In the particular vessel shown, there is not included a rigid or hard top, but rather the containment vessel bladder projects outwardly from the upper ends of the rigid exterior shell.

In the embodiments shown in the attached drawings, vessel 1 is cylindrical in nature having a generally circular horizontal section. It will be appreciated that other shapes of vessels are possible and may be desirable in some applications. As is understood in the art, containment vessel bladder 3 will be of a nature such that it can be folded or collapsed for transport and storage. When it is desirable to retain material within vessel 1, the material is pumped or otherwise delivered into the sealed interior of containment vessel bladder 3 causing the bladder to be filled and expand within the confines of exterior shell 2. To that end, containment vessel bladder 3 will generally be comprised of a pliable (and in some instances possibly flexibly resilient) enclosure having a sealed interior that is defined generally by a floor portion 4 connected to an enclosed top 5 by one or more wall portions 6. Where the containment vessel is generally cylindrical, a single cylindrical wall portion will separate the floor from the enclosed top. An opening or fitting 7 is positioned within a wall portion 6 of the containment vessel bladder in order to permit the bladder to be filled with material or to permit material to be evacuated from the bladder. Typically a hose, pipe or conduit would be connected to opening 7 to allow for filling and evacuation of bladder 3.

In accordance with an embodiment of the invention, containment vessel bladder 3 further includes a drain facilitating element 8 that is positioned on or adjacent to floor portion 4 within the sealed interior of the containment vessel bladder. In the embodiment depicted, drain facilitating element 8 is itself a bladder, which may be referred to as a secondary or lower bladder 9. Secondary bladder 9 may be formed from the same material as containment vessel bladder 3 or an alternate material. Secondary bladder 9 is expandable from a deflated or contracted position to an expanded position. When secondary bladder 9 is in its deflated position it is foldable with containment vessel bladder 3 to facilitate storage and transport of the containment vessel bladder. When it is in its expanded position, secondary bladder 9 at least partially extends from floor portion 4 toward enclosed top 5 of containment vessel bladder 3. Further, when in its expanded position, secondary bladder 9 has one or more sloped surfaces 10 that aid in the direction of material stored within containment vessel bladder 3 toward a predetermined location within bladder 3 to help facilitate with the removal of material from within its sealed interior. In most cases it is expected that the material will be directed to a particular location on floor portion 4.

Secondary bladder 9 is preferably deflated or expanded through the delivery of pressurized fluid to its interior. In many cases it is expected that the pressurized fluid will be pressurized air, however, there may be instances where it desirable to avoid potentially exposing the contents of containment vessel bladder 3 to air (and often, more particularly, oxygen), in which case the pressurized fluid could be water, a glycol mixture, nitrogen, some other gas, etc. In any event, typically a source of pressurized fluid will be positioned adjacent to rigid exterior shell 2 and connected to secondary bladder 9 through a fitting in the exterior of the containment vessel bladder. A conduit 15 would then carry the fluid to secondary bladder 9. It may be desirable to equip bladder containment vessel 1 with pressure gauges indicating the pressure within secondary bladder 9. Through monitoring the pressure within the secondary bladder an operator is able to determine when secondary bladder 9 has been sufficiently expanded for a particular intended purpose.

Figure 3:
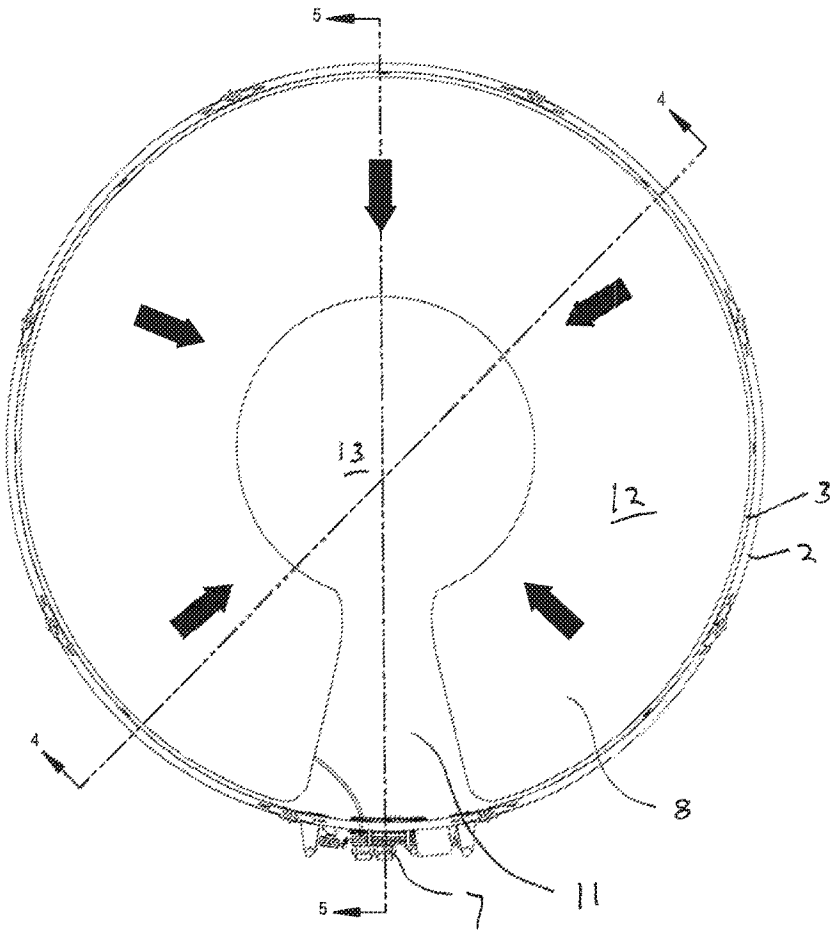
FIG. 3 is a horizontal sectional view taken along the line 3-3 of FIG. 1.
Figure 4:
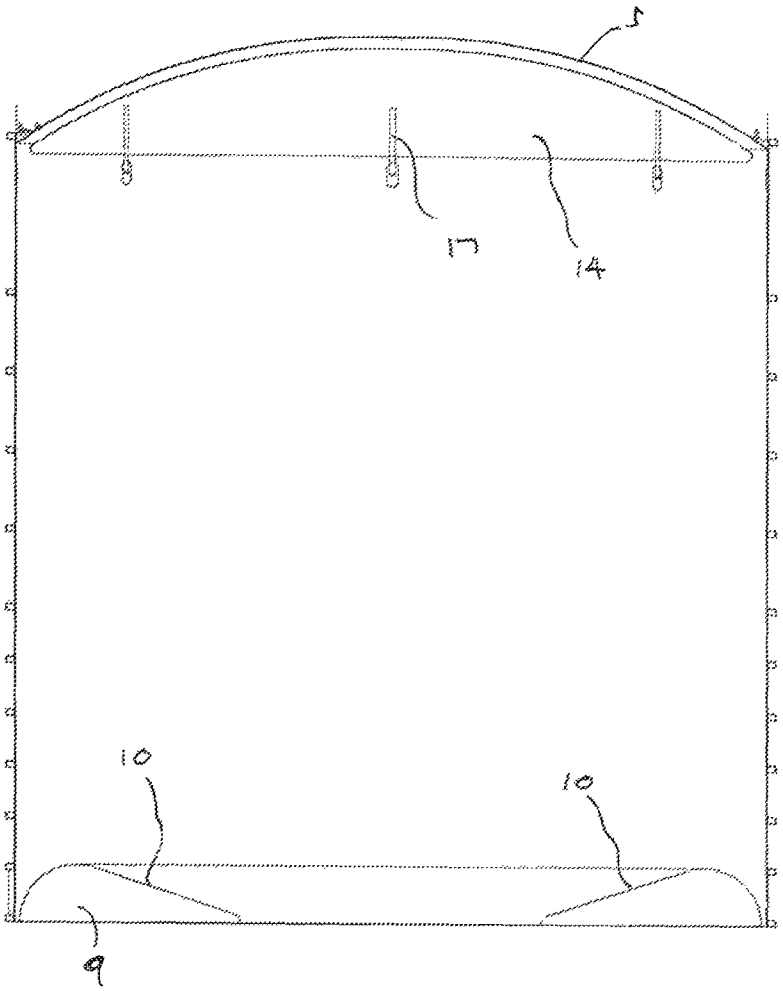
FIG. 4 is a vertical sectional view through the bladder tank taken along the line 4 4 shown in FIG. 3.
Figure 5:
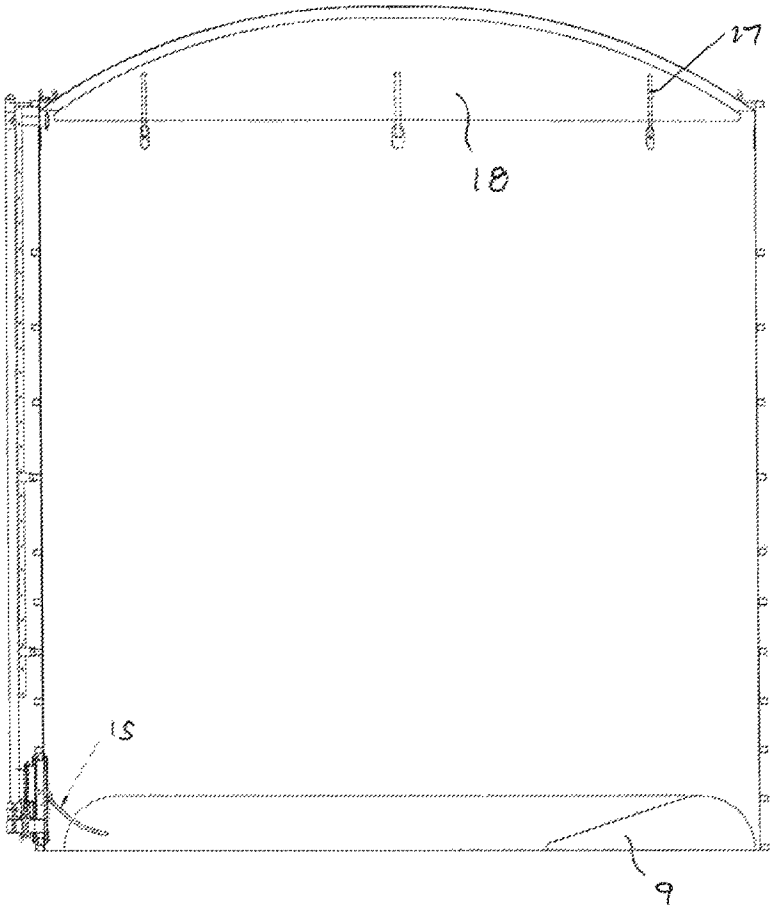
FIG. 5 is a vertical sectional view of the bladder tank taken along the line of 5-5 of FIG. 3.
Figure 6:
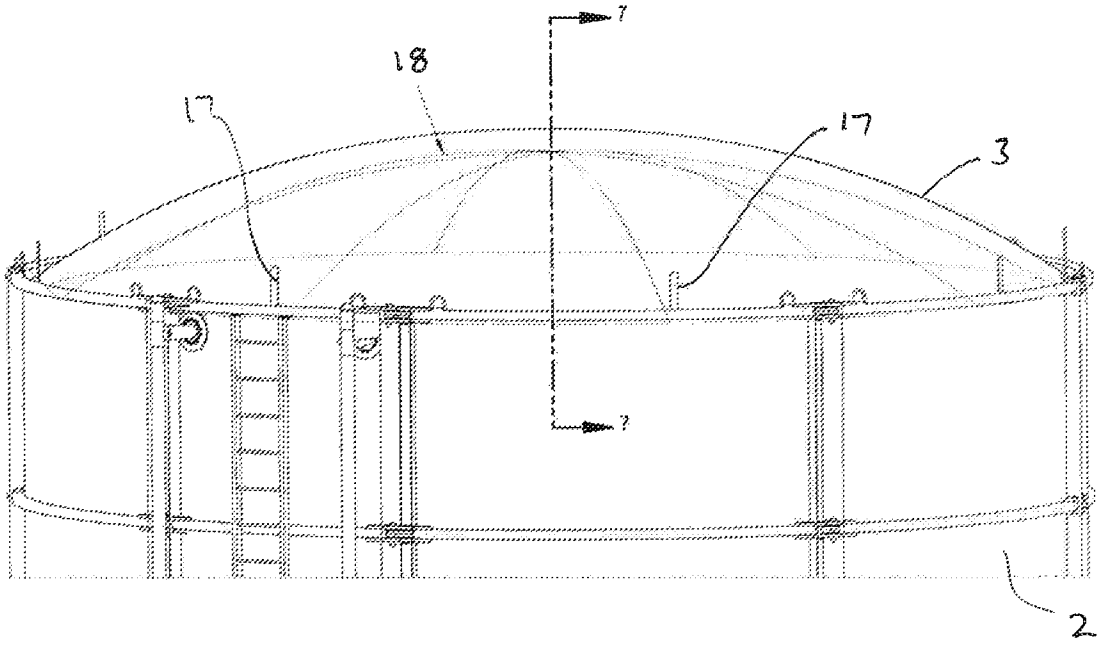
FIG. 6 is an enlarged detailed view of the upper portion of the tank shown in FIG. 1.
Figure 7:
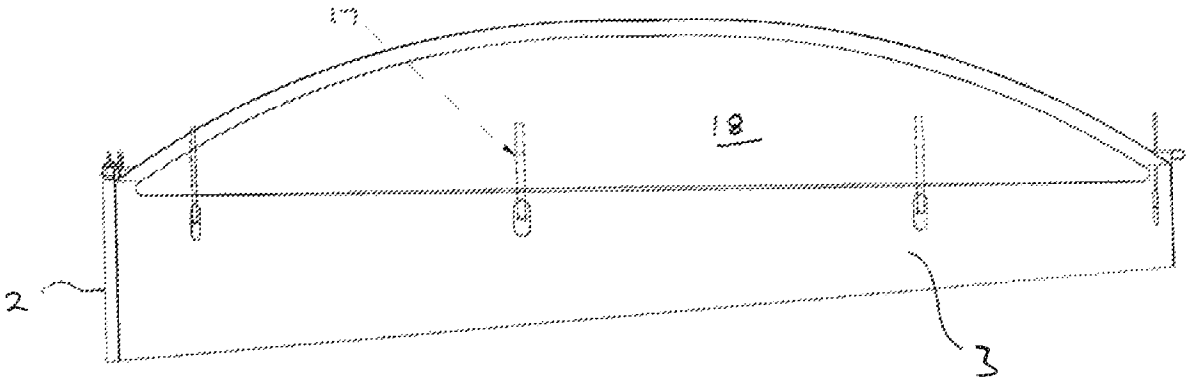
FIG. 7 is a vertical sectional view taken along the line 7-7 of FIG. 6.

With reference specifically to FIG. 3, in an embodiment of the invention secondary bladder 9 is penannular in shape, having a discontinuous portion 11 that is generally adjacent to opening 7 within the wall of containment vessel bladder 3. Further, the upper surface 12 of secondary bladder 9 at least in part slopes towards a central location 13 on floor portion 4 of the containment vessel bladder (see also FIGS. 2, 4 and 5). It will thus be appreciated that when secondary bladder 9 is in its expanded state, it will act to direct material within the interior of containment vessel bladder 3 toward central location 13. In that manner, material that may otherwise collect and remain within the sides of containment vessel bladder 3 (and particularly adjacent to the rigid exterior shell) when bladder 3 is being evacuated will instead tend to be directed toward central location 13 to facilitate its evacuation from within the interior of bladder 3. Depending upon the particular material being stored, the degree of slope of upper surface 12 of secondary bladder 9 can vary. For example, where the material stored within containment vessel bladder 3 is a low viscosity fluid, a small degree of slope will usually be sufficient to help direct the fluid to a central location for its evacuation. Alternately, where the material to be stored within containment vessel bladder 3 is a dry granular product, the slope of upper surface 12 of secondary bladder 9 will preferably be greater than the angle of repose for the product.

In some instances it may desirable to form secondary bladder 9 from a flexibly resilient material that itself is expandable such that increasing or decreasing the pressure within secondary bladder 9 can alter the degree of slope of upper surface 12. It will also be appreciated that although in the attached drawings secondary bladder 9 is shown as penannular in shape, in other instances the bladder could be a generally wedge shaped structure, it could be a structure having sloped surfaces that direct material within containment vessel bladder 3 toward opening 9 as opposed to central location 13, etc. Regardless, the functionality of secondary bladder 9 is to help in the evacuation of material from bladder 3. Where the material being stored is granular, secondary bladder 9 can help to prevent material from "hanging up" or remaining along the exterior side edges of the interior of containment vessel bladder 3. Where the material is a liquid, secondary bladder 9 may assist in directing the last portions of the liquid that are left inside bladder 3 to a particular location to facilitate removal.

In a further embodiment of the invention containment vessel bladder 3 includes a ceiling shape retaining element 14 that is positioned within the interior of containment vessel bladder 3 and adjacent to enclosed top 5. In the embodiment depicted, ceiling shape retaining element 14 is in the form of a bladder, which may be referred to as a third or upper bladder 18. Upper bladder 18 has an inflated configuration and a deflated configuration. When it is in its deflated configuration bladder 18 is foldable with the containment vessel bladder to facilitate storage and transport. When it is in its inflated configuration upper bladder 18 bears against enclosed top 5 of containment vessel bladder 3 to assist in maintaining the enclosed top in a taught configuration, and to thereby aid in permitting the enclosed top to shed precipitation or other debris that may come into contact with it. Preferably upper bladder 18 will be inflated through the use of a source of pressurized fluid, and in some cases the same source of pressurized fluid that is used to expand secondary bladder 9. In that regard, with reference to FIG. 2 and there is depicted a conduit 16 that extends from the outer wall of containment vessel portion 3 to upper bladder 18 to supply or evacuate pressurized fluid from the upper bladder. As in the case of the pressurization of secondary bladder 9, vessel 1 may include pressure gauges to indicate the pressure within the interior of upper bladder 18 in order for an operator to determine when upper bladder 18 has been pressurized to a desired degree. In one embodiment, conduits 15 and 16 may be linked or connected together to permit secondary bladder 9 and upper bladder 18 to be simultaneously inflated or deflated.

Where bladder containment vessel 1 is generally cylindrical in nature, in many instances the enclosed top of containment vessel bladder 3 will be generally dome shaped. In such instances upper bladder 18, when in its inflated configuration, will preferably have an upper surface that is also generally dome shaped and that corresponds generally to the curvature of enclosed top 5 of containment vessel bladder 3. Configuring upper bladder 18 in such a manner permits the bladder to help to maintain the dome shape of enclosed top 5 and further assists in allowing the dome shape of enclosed top 5 to shed water, snow, ice or other debris that may fall upon it. It will, however, be appreciated by one of ordinary skill in the art that in other instances enclosed top 5 of containment vessel bladder 3 may be an inclined flat surface, or may take the form of a more traditional pitched or hip roof. In such cases upper bladder 18 will have a corresponding shape when in its inflated configuration.

Upper bladder 18 may be constructed from a material that is the same or different from that of containment vessel bladder 3 and secondary bladder 9. Further, if desired the material from which upper bladder 18 is constructed may be flexibly resilient to permit the upper bladder to be stretched and further expanded while under pressurization. In the embodiment depicted in the attached drawings, upper bladder 18 is secured to wall portion 6 of containment vessel bladder 3 through the use of a plurality of straps 17. Straps 17 permit the upper bladder to be held in place at the top of containment vessel bladder 3, while at the same time allowing for a degree of adjustment of the vertical positioning of the upper bladder.

It will be appreciated that not only will upper bladder 18 assist in maintaining enclosed top 5 of container vessel bladder 3 in a taught configuration to permit the shedding of precipitation, but that it will also add an element of insulation to the upper portion of the bladder containment vessel. Where the bladder containment vessel is to be deployed in areas of extreme heat or extreme cold, the added degree of insulation provided by the upper bladder may assist in helping to maintain the temperature of the contents of bladder containment vessel 1 within a desired range.

Whereas, the embodiments have been described in relation to the drawings, it should be understood that other and further modifications, apart from those shown or suggested herein, may be made within the scope of this invention.

What is claimed is:

1. A containment vessel bladder for retaining material to be stored within a containment vessel, the bladder comprising:

a flexible enclosure having a sealed interior defined generally by a floor portion connected to an enclosed top by one or more wall portions, said enclosure further including an opening for the delivery of material into and the evacuation of material from said sealed interior, and a drain facilitating element positioned on said floor portion within said sealed interior of said flexible enclosure, said drain facilitating element expandable from a deflated or contracted position to an expanded position, when in said deflated position said drain facilitating element foldable with said enclosure to facilitate storage and transport of said containment vessel bladder, when in said expanded position said drain facilitating element having one or more sloped surfaces aiding in the direction of material stored within said sealed interior toward a pre-determined location within said sealed interior to help facilitate the removal of material from said containment vessel bladder, said drain facilitating element being a flexible secondary bladder that is generally penannular having a discontinuous portion generally adjacent to said opening in said enclosure.

2. The containment vessel bladder as claimed in claim 1 wherein said drain facilitating element is a flexible secondary bladder that is expanded from said deflated position to said expanded position through the delivery of pressurized fluid to said secondary bladder.

3. The containment vessel bladder as claimed in claim 2 wherein said pressurized fluid is pressurized air.

4. The containment vessel bladder as claimed in claim 1 wherein the containment vessel is generally circular in horizontal section.

5. The containment vessel bladder as claimed in claim 4 wherein said secondary bladder has an upper surface that at least in part slopes toward a central location on said floor portion for directing material received within said containment vessel bladder toward said central location when the material is being evacuated from said sealed interior.

6. The containment vessel bladder as claimed in claim 1 wherein said drain facilitating element has an upper surface at least in part sloping downwardly and toward a central location on said floor portion for directing material received within said enclosure toward the central location when the material is being evacuated from said sealed interior.

7. The containment vessel bladder as claimed in claim 1 including a ceiling shape retaining element positioned adjacent to said enclosed top and within the interior of said containment vessel bladder.

8. The containment vessel bladder as claimed in claim 7 wherein said ceiling shape retaining element comprises an upper bladder having an inflated configuration and a deflated configuration, when in said inflated configuration said upper bladder bearing against said enclosed top to aid in permitting said enclosed top to shed precipitation or other debris that may come into contact therewith.

9. The containment vessel bladder as claimed in claim 8 wherein said upper bladder is inflated through the use of a source pressurized fluid.

10. The containment vessel bladder as claimed in claim 9 wherein said drain facilitating element is expanded through the use of a source pressurized fluid.

11. A containment vessel bladder for retaining material to be stored within a containment vessel, the bladder comprising:

a flexible enclosure having a sealed interior defined generally by a floor portion connected to an enclosed top by one or more wall portions, said enclosure further including an opening for the delivery of material into and the evacuation of material from said sealed interior, and a drain facilitating element positioned on said floor portion within said sealed interior of said flexible enclosure, said drain facilitating element expandable through use of a source of pressurized fluid from a deflated position to an expanded position, when in said deflated position said drain facilitating element foldable with said enclosure to facilitate storage and transport of said containment vessel bladder, when in said expanded position said drain facilitating element having one or more sloped surfaces aiding in the direction of material stored within said sealed interior toward a pre-determined location within said sealed interior to help facilitate the removal of material from said containment vessel bladder;

the containment vessel bladder further including a ceiling shape retaining element in the form of an upper bladder positioned adjacent to said enclosed top and within the interior of said containment vessel, said upper bladder having an inflated configuration and a deflated configuration and inflated through use of a of a source pressurized fluid, wherein the same source of pressurized fluid is used to expand said drain facilitating element and to inflate said upper bladder.

12. The containment vessel bladder as claimed in claim 8 wherein said one or more wall portions of said flexible enclosure form a generally cylindrical structure with said enclosed top generally dome shaped, said upper bladder having an upper surface generally dome shaped and corresponding generally to the curvature of said enclosed top when said upper bladder is in said inflated configuration.

13. The containment vessel bladder as claimed in claim 8 wherein said upper bladder has an upper sloped surface contacting said enclosed top when said upper bladder is in said inflated configuration, said upper sloped surface of said upper bladder assisting said enclosed top to shed precipitation or other debris that may come into contact therewith.

14. The containment vessel bladder as claimed in claim 8 wherein said upper bladder, when in said inflated position, assists in insulating said enclosure.

15. The containment vessel bladder as claimed in claim 11 further including a conduit linking said drain facilitating element to said upper bladder, thereby permitting said drain facilitating element and said upper bladder to be simultaneously inflated or deflated.

16. The containment vessel bladder as claimed in claim 7 wherein said ceiling shape retaining element is secured to said one or more wall portions adjacent to said enclosed top through the use of straps.

17. A containment vessel bladder for retaining material to be stored within a containment vessel, the bladder comprising: a flexible enclosure having a sealed interior defined generally by a floor portion connected to an enclosed top by one or more wall portions, said enclosure further including an opening for the delivery of material into and the evacuation of material from said sealed interior, and a ceiling shape retaining element positioned adjacent to said enclosed top and within the interior of said containment vessel bladder, said ceiling shape retaining element comprising an upper bladder having an inflated configuration and a deflated configuration, said upper bladder expandable from a deflated configuration to said expanded configuration through use of a source of pressurized fluid, when in said inflated configuration said upper bladder bearing against said enclosed top to aid in permitting said enclosed top to shed precipitation or other debris that may come into contact therewith, the containment vessel bladder including a drain facilitating element positioned on said floor portion within said sealed interior of said flexible enclosure, said drain facilitating element expandable from a deflated position to an expanded position through use of a source of pressurized fluid, when in said deflated position said drain facilitating element foldable with said enclosure to facilitate storage and transport of said containment vessel bladder, when in said expanded position said drain facilitating element having one or more sloped surfaces aiding in the direction of material stored within said sealed interior toward a pre-determined location within said sealed interior to help facilitate the removal of material from said containment vessel bladder, wherein the same source of pressurized fluid is used to expand said drain facilitating element and to inflate said upper bladder.

* * * * *